US005991146A

United States Patent [19]

Bokhary

[11] Patent Number: 5,991,146

[45] Date of Patent: Nov. 23, 1999

[54] METHOD AND DEVICE TO REDUCE ELECTRICAL INSULATOR FLASHOVER

[76] Inventor: Tario I. Bokhary, Sceco E., P.O. Box 5190, Generation Department, Dammam, Saudi Arabia, 31422

[21] Appl. No.: 09/146,759

[22] Filed: Sep. 4, 1998

Related U.S. Application Data

[60] Provisional application No. 60/057,500, Sep. 4, 1997.

[51] Int. Cl.[6] ..... H05F 03/06

[52] U.S. Cl. ..... 361/213; 361/220; 361/230

[58] Field of Search ..... 361/212, 213, 361/216, 220, 223, 224, 225, 229, 230, 235

[56] References Cited

U.S. PATENT DOCUMENTS

| | | | |
|---|---|---|---|
| 3,963,858 | 6/1976 | Cheng et al. | 174/141 R |
| 4,010,316 | 3/1977 | Jolly et al. | 174/140 R |
| 4,125,742 | 11/1978 | Rabinowitz | 174/211 |
| 4,364,752 | 12/1982 | Fitch et al. | 96/64 |
| 4,539,022 | 9/1985 | McLoughlin | 96/40 |
| 4,944,778 | 7/1990 | Yanagawa | 96/66 |
| 5,141,529 | 8/1992 | Oakley et al. | 95/57 |
| 5,694,286 | 12/1997 | Fowler et al. | 361/212 |

*Primary Examiner*—Fritz Fleming
*Attorney, Agent, or Firm*—Richard C. Litman

[57] ABSTRACT

A device that reduces power transmission insulator flashover by preventing the buildup of contaminants and dust on the surface of electrical insulators. The device is primarily designed for use on high tension wire insulators and creates an envelope of positive and negative ions that cover the insulators' skirts and consequently repels dust and other particles. The device is embedded in at least one insulator skirt and includes a small induction coil, a diode, a series of capacitors, and a fine needle that are employed as an ion generator which produces a negative or positive polarity ion corona region. The induction coil produces an AC voltage that is induced by the power line current. This AC voltage is rectified by the diode. As contaminants and dust particles approach the surface of the skirt, they become charged with the same polarity as the ions leaving the needle, and are consequently repelled from the corona region. The device reduces the possibility of flashovers by preventing contaminants from landing on the surface of the insulators and preventing the accumulation of "dry bands".

14 Claims, 3 Drawing Sheets

METHOD AND DEVICE TO REDUCE ELECTRICAL INSULATOR FLASHOVER

CROSS-REFERENCE TO RELATED APPLICATION

This application claims the benefit of U.S. Provisional Patent Application Serial No. 60/057,500, filed Sep. 4, 1997.

BACKGROUND OF THE INVENTION

1. Field of the Invention

The present invention relates to a device that reduces power transmission insulator flashover by preventing the buildup of contaminants and dust on the surface of insulators. More specifically, the present invention is a flashover prevention device for power transmission insulators that creates an envelope of positive and negative ions that covers the insulators' skirts and consequently repels dust and other particles.

2. Description of Related Art

High tension AC power lines typically are suspended from metal towers by insulators comprising a series of insulating skirts (also known as dishes, discs, sheds or shells). Contaminants and dust that accumulate on these skirts reduce the electrical resistance of the insulators, thereby increasing the probability of electrical current flow known as flashover. These contaminants may be generated by salt water, road salt, saltflats, desert dusts, petrochemical industries, etc., and may be transported to the surface of the insulator by gravity, electrostatic attraction, migration of high-permittivity particles into regions of large electric fields, evaporation of solutions and wind. When these materials are deposited on the insulator surface, they behave as a highly variable resistor that tends to be unstable in the presence of electric fields. The leakage current through this resistance causes heat, electrochemical reactions, discharges and flashover.

When this occurs, the ability of the insulator to resist flashover is primarily determined by: the shape of the insulator; the attitude of the insulator (vertical, inclined or horizontal); the properties of the surface of the insulator (hydrophobicity, roughness, surface free energy); and the stickiness or strength of adhesion to contaminants (thereby increasing the insulator's ability to become moist and a tendency to become polluted). The flashover voltage of a polluted insulator depends upon the amount and nature of the pollutants. The degree of pollution by conductive materials is usually estimated by the equivalent salt deposit density (ESDD). Generally, flashover voltage of a polluted insulator is inversely proportional to about ⅕ the power of ESDD in AC systems and ⅓ the power of ESDD in DC systems. Pollutants also contain non-conductive or insoluble materials, measured by the non-soluble material deposit density (NSDD). These materials must be considered in that they affect retention of water, and the ability of the conductive materials to be washed away by dew, fog, rain, etc.

In addition to ESDD and NSDD, flashover voltage characteristics are influenced by wetting of the insulator surface. When a polluted insulator is dry, its flashover voltage level is similar to the level of a clean and dry insulator. The chance of flashover is increased when the wetting is caused by fog, humidity or light rain, because in heavier wetting the pollutant may tend to be washed away. As the surface insulation resistance is lowered, leakage current flows along the surface forming "dry bands". The formation of "dry bands" results in a non-uniform potential distribution that eventually leads to flashover.

Several related art devices have been developed to reduce the accumulation of contaminants on these insulators. One such device consists of the use of an oil bath open to the atmosphere. This technique had to be abandoned, however, because of the deterioration and splashing away of the oil itself. U.S. Pat. No. 3,963,858, issued on Jun. 15, 1976 to Tsen-Chung Cheng et al., describes flashover prevention means for high voltage insulators comprising discrete conductive regions which intercept an electrical arc. U.S. Pat. No. 4,010,316, issued on Mar. 1, 1977 to David C. Jolly et al., describes a high voltage electrical insulator which uses magnetic elements to prevent flashover by deflecting the flashover using a magnetic current. U.S. Pat. No. 4,125,742, issued on Nov. 14, 1978 to Mario Rabinowitz, discusses preventing flashover in tiered insulators by optimizing the relationship between core diameter, tier separation, free path length and total path length between the outer surface and inner core. It should be noted that ionization and ion generating are not disclosed or suggested in any of these references.

U.S. Pat. No. 4,364,752, issued on Dec. 21, 1982 to Richard A. Fitch et al., U.S. Pat. No. 4,539,022, issued on Sep. 3, 1985 to Joseph R. McLoughlin, U.S. Pat. No. 4,944,778, issued on Jul. 31, 1990 to Motoo Yanagawa, and U.S. Pat. No. 5,141,529, issued on Aug. 25, 1992 to Clive C. Oakley et al., all describe various methods and devices for removing particles from gaseous mediums using ionization. The use of these devices to repel particles or dust from electrical insulators is not disclosed or suggested by any of these references. In fact, the large size and/or collection methods used by these devices precludes their use on power line insulators.

Thus, there exists a need for an insulator device for use on high tension AC power lines that prevents the accumulation of particulate contaminants to reduce the likelihood of a flashover event.

None of the above inventions and patents, taken either singly or in combination, is seen to describe the instant invention as claimed.

SUMMARY OF THE INVENTION

The present invention is a device which prevents the accumulation of pollutants and particulate contaminants on high tension power line insulator devices through the use of ionization. As is well known, ionization is the formation of ions from atoms or molecules by the removal or addition of electrons. Ions migrate in an electric field and bind strongly to solvent molecules such as water. Ions of like polarity are repelled by one another, while ions of unlike polarity are attracted to one another. Negative ions will attach themselves to dust and other airborne particles, neutralize the particles and weigh them down. After an electrical storm negative ions clean the air by this mechanism. Electrostatic precipitators (like those discussed in the related art) remove liquid or solid particles from a gas using this same phenomenon. The suspension passes through an electric or corona discharge area where ionization of the gas occurs. The ions collide with the suspended particles and confer an electric charge thereon, rendering the particles to easy collection.

The present invention reduces the accumulation of pollutants on electrical insulators by producing an ion corona region on the surface of the insulators. Insulator's typically comprise a number of skirts, the number of skirts being chosen depending on the level of isolation required. An insulator skirt includes a cap and an integral curved lower section, which together provide the skirt with a generally bell-shaped appearance.

The reduction of accumulation of pollutants on electrical insulators is accomplished by an ion generator which includes a coil which utilizes the existing electrical fields surrounding AC power lines to produce an AC current. The ion generator of the present invention is installed at least on the lower skirts of the insulator (preferably the lowest three). The ion generator includes a coil having a predetermined number of loops that is used to develop an AC current which is induced by the AC current flowing in the high tension wires. The AC current is then rectified by a diode and supplied as a DC current to a series of capacitors. Each of the capacitors changes the polarity of the ions generated, and therefore the final polarity is determined by the number of capacitors in the series. This DC current is supplied to a fine needle or probe to generate an ion "wind" which either repels particles away from the insulators (positive ions), or attracts the particles to the tower or adjacent metals (negative ions). Negative ion generation is preferred because when they are negatively ionized, dust particles will be drawn to the metal tower and other grounded metallic surfaces.

Accordingly, it is a principal object of the invention to provide a device capable of reducing the probability of flashover across high voltage AC transmission system insulators.

It is another object of the invention to provide a device which reduces the accumulation of pollutants and particulate contaminants on the surface of an electrical insulator.

It is an object of the invention to provide improved elements and arrangements thereof in a device for reducing electrical insulator flashover for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
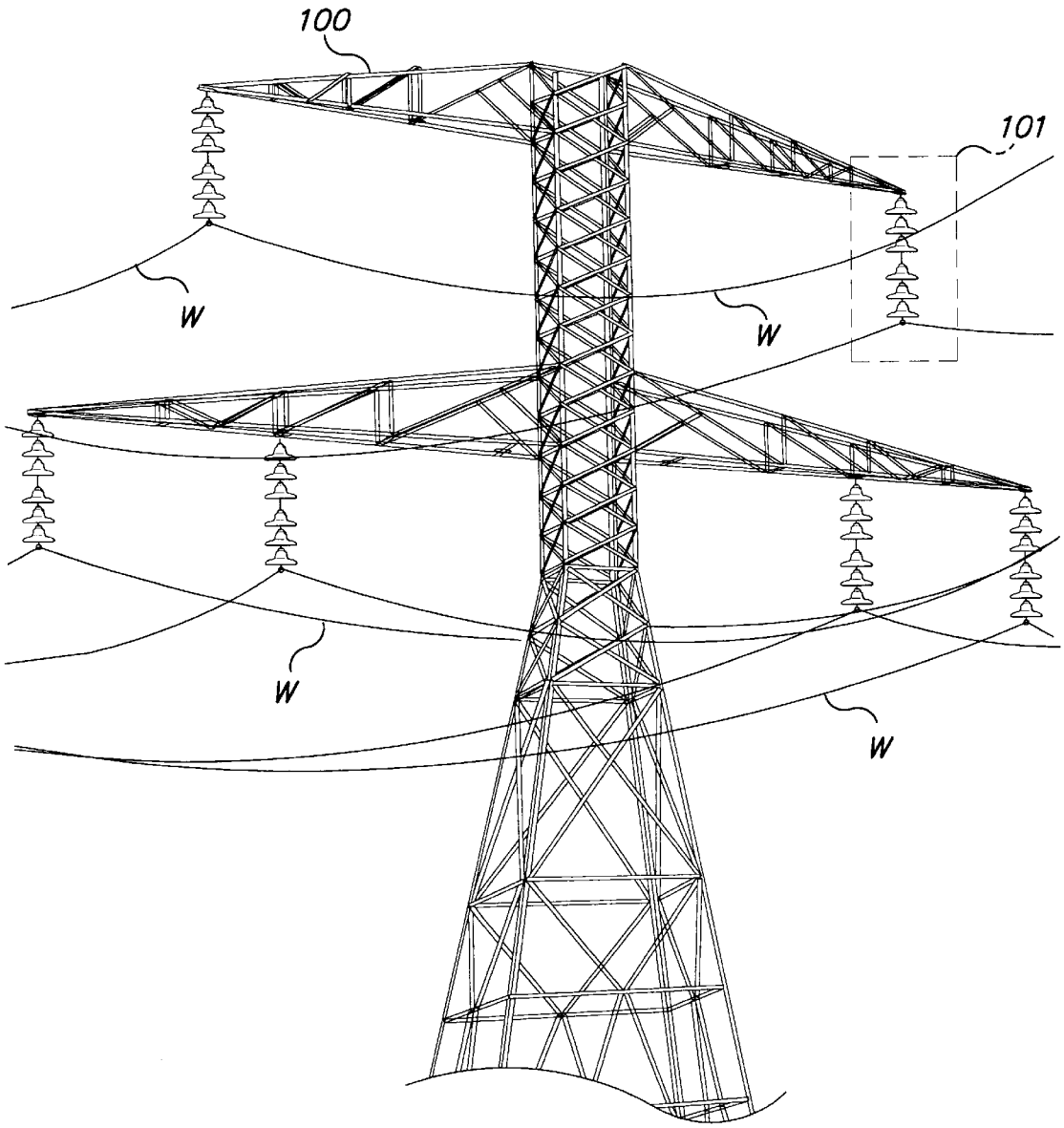
FIG. 1 is an environmental view of a high tension wire tower utilizing the device of the present invention.
Figure 2:
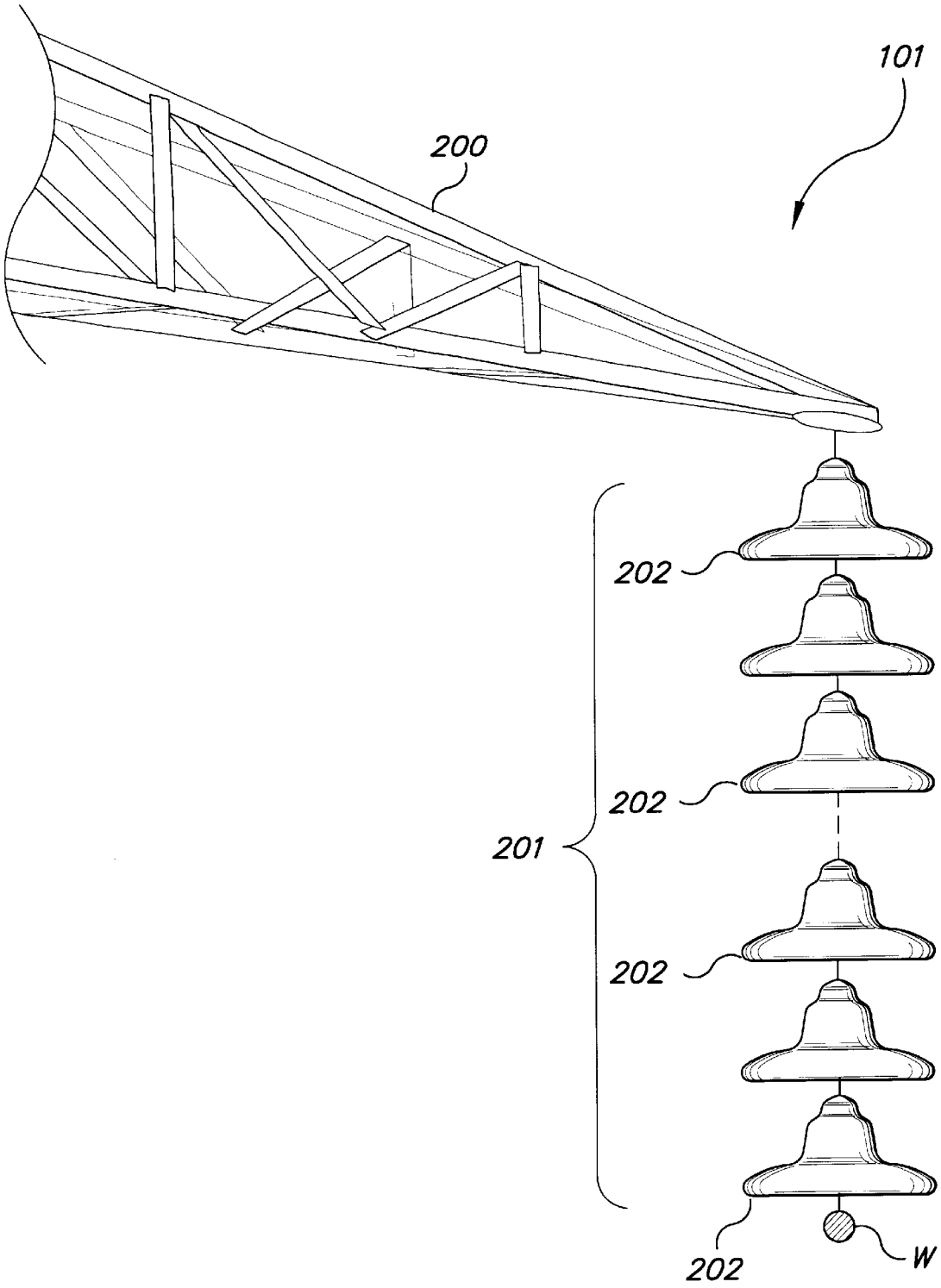
FIG. 2 is a close-up view of a series of insulating skirts used to attach high tension wires to the tower and containing the device of the present invention.

The present invention is primarily designed for use with high voltage AC transmission system insulators on a high tension wire tower 100 as shown in FIG. 1. The high tension wires W are held above the ground by tower 100. As can be seen in FIG. 2, section 101 has been enlarged to show the insulator area. An insulator 201 is attached to an arm 200 of the tower 100 at the top, and supports a high tension wire W (shown in cross section in FIG. 2) at the bottom. The insulator 201 comprises a number of skirts 202, the number of skirts being chosen depending on the level of isolation required. The device of the present invention is installed at least on the lower skirts of the insulator (preferably the lowest three). It should be noted, however, that all of the skirts may be equipped with the device of the present invention.

Figure 3:
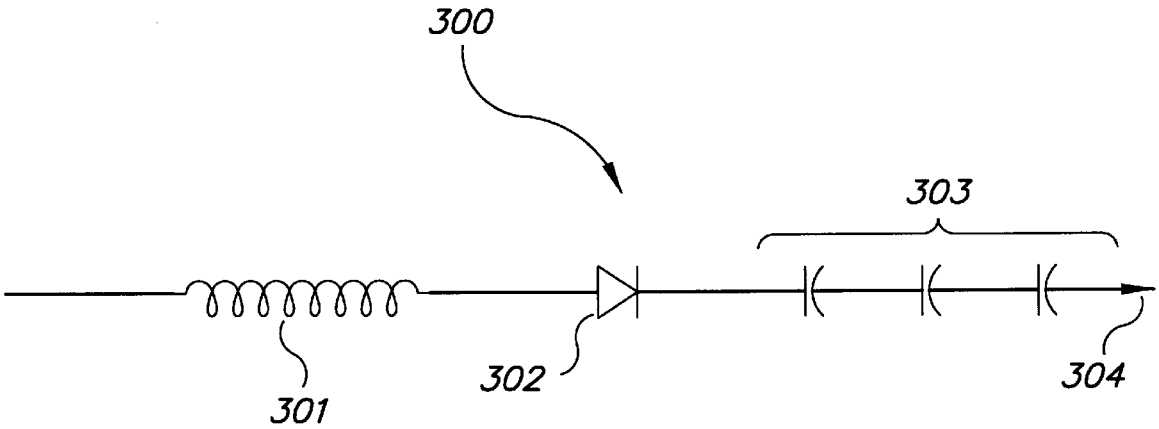
FIG. 3 is a circuit diagram of the present invention.

FIG. 3 shows a circuit diagram of an ion generator, generally denoted at 300. A coil 301 having a predetermined number of loops is used to develop an AC current that is induced by the AC current flowing in the high tension wires W. The AC current is then rectified by a diode 302 and supplied as a DC current to a series of capacitors 303. A fine needle or probe 304 is provided to generate negative or positive ions.

Figure 4:
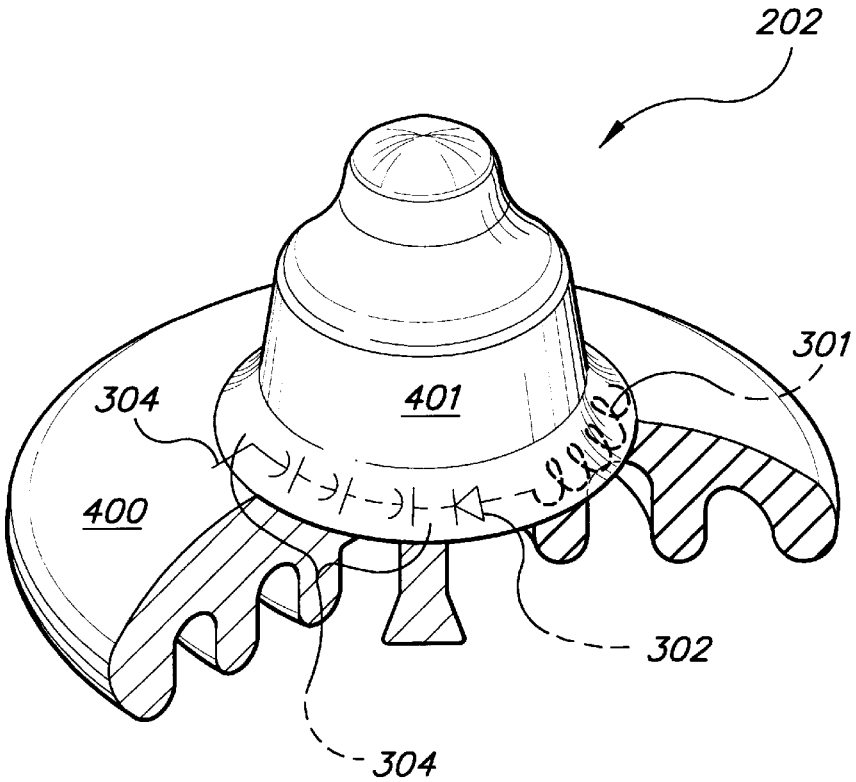
FIG. 4 is a fragmented view of an insulating skirt containing the circuit of FIG. 3.

A fragmented section of an insulator skirt 202 is shown in FIG. 4. Each insulator skirt 202 includes a cap 401 and an integral curved lower section 400, which together provide the skirt with a generally bell-shaped appearance. As shown in FIG. 4, the circuit of the present invention is embedded within the lower portion of the cap 401 of the skirt 202 adjacent the curved lower section 400. Note that the diode 302 and the series of capacitors 303 have been omitted from FIG. 4 for clarity. The circuit 300 may alternatively be glued by epoxy resin to the surface of the insulator for retrofitting on existing insulators. Regardless of how the circuit is secured to the skirt, the needle 304 extends from the surface of the skirt 202 where it is exposed to the atmosphere for generating negatively or positively charged ions. It should be noted that while only a single needle 304 is shown, preferably several needles are employed.

The corona region emanates from the needle 304, and within this region a dense cloud of free electrons and positive or negative ions is produced. If the needle is positive with respect to the insulator, the electrons will move rapidly to the needle and the positive ions will stream away from the needle. If the needle is negative with respect to the insulator, positive ions will move rapidly toward the needle and electrons and negative ions will be repelled away from the needle. A negatively charged needle is preferred because it results in the movement of dust and other particulate contaminants away from the needle such that they will be drawn to the metal tower and other grounded metallic surfaces. The corona which is produced effectively prevents the accumulation of dust and other particulate contaminants on the insulator's surface. To determine the appropriate size of the needle or probe, the following field strength formula is used:

$$E_b=30+12.7(D_w)^{1/2}$$

$E_b$ is in units of kV/cm, while $D_w$ is in cm and is the diameter of the needle. The higher the insulator, the thicker (larger cross sectional area) the needle needs to be to produce the same voltage. Testing indicates that four insulators employing the present invention are sufficient to break the flashover pattern.

It is to be understood that the present invention is not limited to the embodiment described above, but encompasses any and all embodiments within the scope of the following claims.

I claim:

1. A device for reducing flashover across insulators on an electrical power line, said device comprising:

a coil formed by several loops in a wire, said coil producing an AC voltage induced by current flowing in the power line;

a diode electrically connected to the coil for rectifying said AC voltage to produce a DC voltage; and a needle electrically connected to said diode for producing a polarized ion corona region on a surface of the insulators;

wherein said polarized ion corona region reduces an accumulation of contaminants on the surface of the insulators, thereby reducing power line insulator flashover.

2. The device according to claim 1 further comprising a number of capacitors connecting said needle to said diode.

3. The device according to claim 1 wherein said polarized ion corona region has a negative polarity.

4. The device according to claim 1 wherein said polarized ion corona region has a positive polarity.

5. A method for reducing flashover across insulators on electrical power lines, said method comprising the steps of:

a) using an ion generator to produce one of a negative or positive polarity ion corona region on a surface of the insulators;

b) providing said ion generator with a coil, said coil producing an AC current induced by current in the power lines.

6. The method according to claim 5 further including the step of providing said ion generator with a diode, said diode rectifying said AC current to produce a DC current.

7. The method according to claim 6 further including the step of providing said ion generator with a number of capacitors.

8. The method according to claim 5 wherein said polarity is positive.

9. The method according to claim 5 wherein said polarity is negative.

10. The method according to claim 7 further including the step of providing said ion generator with a needle, said ion corona region emanating from said needle.

11. A device for reducing power line insulator flashover in combination with an insulator for supporting an electrical power line, said insulator including a plurality of skirts, said device comprising:

a coil formed by several loops in a wire, said coil producing an AC voltage induced by current flowing in the power line;

a diode electrically connected to the coil for rectifying said AC voltage to produce a DC voltage; and a needle electrically connected to said diode for producing a polarized ion corona region on a surface of said insulator that reduces an accumulation of contaminants on said surface of said insulator, thereby reducing power line insulator flashover;

wherein said device is installed on an insulator skirt.

12. The insulator according to claim 11, wherein said device further comprises a number of capacitors connecting said needle to said diode.

13. The insulator according to claim 11 wherein said polarized ion corona region has a negative polarity.

14. The insulator according to claim 11 wherein said polarized ion corona region has a positive polarity.

* * * * *